US009174322B2

(12) United States Patent
Matsui et al.

(10) Patent No.: US 9,174,322 B2
(45) Date of Patent: Nov. 3, 2015

(54) MANUFACTURING METHOD OF SEMICONDUCTOR DEVICE

(71) Applicant: KABUSHIKI KAISHA TOSHIBA, Tokyo (JP)

(72) Inventors: Yukiteru Matsui, Nagoya (JP); Akifumi Gawase, Kuwana (JP); Hajime Eda, Yokkaichi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/193,774

(22) Filed: Feb. 28, 2014

(65) Prior Publication Data

US 2015/0004878 A1 Jan. 1, 2015

(30) Foreign Application Priority Data

Jun. 28, 2013 (JP) ..... 2013-137447

(51) Int. Cl.

| | |
|---|---|
| ***B24B 37/00*** | (2012.01) |
| ***B24B 37/04*** | (2012.01) |
| ***B24B 53/017*** | (2012.01) |
| ***B24B 37/015*** | (2012.01) |
| ***B24B 49/00*** | (2012.01) |
| ***B24B 49/16*** | (2006.01) |

(52) U.S. Cl.

CPC ..... *B24B 37/042* (2013.01); *B24B 37/015* (2013.01); *B24B 49/006* (2013.01); *B24B 49/16* (2013.01); *B24B 53/017* (2013.01)

(58) Field of Classification Search

CPC ..... B24B 53/017; B24B 53/12; B24B 37/04; B24B 57/02; B24B 37/042; B24B 37/26; B24B 53/095; B24B 55/02; B24B 1/00; B23Q 11/10; B23Q 49/14; B24D 7/10

USPC ..... 451/21, 450, 53, 56, 443

See application file for complete search history.

(56) References Cited

U.S. PATENT DOCUMENTS

| | | | | | |
|---|---|---|---|---|---|
| 5,216,843 | A | * | 6/1993 | Breivogel et al. | 451/285 |
| 5,607,718 | A | * | 3/1997 | Sasaki et al. | 438/584 |
| 5,749,772 | A | * | 5/1998 | Shimokawa | 451/53 |
| 5,785,585 | A | * | 7/1998 | Manfredi et al. | 451/288 |
| 5,934,981 | A | * | 8/1999 | Tanaka et al. | 451/41 |
| 6,000,997 | A | * | 12/1999 | Kao et al. | 451/7 |
| 6,139,428 | A | * | 10/2000 | Drill et al. | 451/41 |

(Continued)

FOREIGN PATENT DOCUMENTS

| | | |
|---|---|---|
| JP | 07-112362 | 5/1995 |
| JP | 2000-006013 | 1/2000 |

OTHER PUBLICATIONS

Surface Topography Modelling for Reduced Friction—Sedlacek et al. Jun. 22, 2010.*

*Primary Examiner* — George Nguyen

(74) *Attorney, Agent, or Firm* — Finnegan, Henderson, Farabow, Garrett & Dunner, L.L.P.

(57) ABSTRACT

In accordance with an embodiment, a manufacturing method of a semiconductor device includes forming a polish target film on a substrate and conducting a CMP process for the polish target film. The conducting the CMP process includes bringing a surface of the polish target film into contact with a surface of a polishing pad with a negative Rsk value, and adjusting friction dependency on polishing speed between the polish target film and the polishing pad to a value that restrains the occurrence of a stick slip to polish the polish target film.

20 Claims, 7 Drawing Sheets

(56) References Cited

U.S. PATENT DOCUMENTS

| | | | | |
|---|---|---|---|---|
| 6,231,425 | B1 * | 5/2001 | Inaba et al. | 451/5 |
| 6,402,588 | B1 * | 6/2002 | Matsuo et al. | 451/5 |
| 6,579,157 | B1 * | 6/2003 | Gotkis et al. | 451/56 |
| 6,585,567 | B1 * | 7/2003 | Black et al. | 451/36 |
| 6,806,193 | B2 * | 10/2004 | Korthuis et al. | 438/692 |
| 8,025,759 | B2 | 9/2011 | Sasaki et al. | |
| 8,398,811 | B2 | 3/2013 | Sasaki et al. | |
| 2004/0166779 | A1 * | 8/2004 | Balijepalli et al. | 451/41 |
| 2006/0166503 | A1 * | 7/2006 | Sasaki et al. | 438/692 |
| 2006/0199472 | A1 * | 9/2006 | Taylor | 451/5 |
| 2007/0287367 | A1 * | 12/2007 | Kim et al. | 451/527 |
| 2009/0221216 | A1 * | 9/2009 | Fujita | 451/56 |
| 2010/0240283 | A1 | 9/2010 | Nemoto et al. | |
| 2011/0143640 | A1 * | 6/2011 | Bajaj | 451/56 |
| 2011/0306274 | A1 | 12/2011 | Sasaki et al. | |
| 2013/0331004 | A1 * | 12/2013 | Minamihaba et al. | 451/53 |
| 2013/0331005 | A1 * | 12/2013 | Gawase et al. | 451/56 |

* cited by examiner

MANUFACTURING METHOD OF SEMICONDUCTOR DEVICE

CROSS-REFERENCE TO RELATED APPLICATIONS

This application is based upon and claims the benefit of priority from the prior Japanese Patent Application No. 2013-137447, filed on Jun. 28, 2013, the entire contents of which are incorporated herein by reference.

FIELD

Embodiments described herein relate generally to a manufacturing method for a semiconductor device.

BACKGROUND

Manufacturing processes of semiconductor devices include, for example, shallow trench isolation (STI) –chemical mechanical polishing (CMP), and pre-metal dielectric (PMD) –CMP. In these CMPs, for example, a silicon oxide film formed on a substrate is a polish target film, and is planarized.

However, the surface of the polish target film (silicon oxide film) after the CMP may be scratched depending on the state of the surface of a polishing pad of a polisher. This may lead to deterioration in yield and reliability.

DETAILED DESCRIPTION

In accordance with an embodiment, a manufacturing method of a semiconductor device includes forming a polish target film on a substrate and conducting a CMP process for the polish target film. The conducting the CMP process includes bringing a surface of the polish target film into contact with a surface of a polishing pad with a negative Rsk value, and adjusting friction dependency on polishing speed between the polish target film and the polishing pad to a value that restrains the occurrence of a stick slip to polish the polish target film.

Embodiments will now be explained with reference to the accompanying drawings. Like components are provided with like reference signs throughout the drawings and repeated descriptions thereof are appropriately omitted. In the present specification, the rotational speed dependence (Nm/rpm) of the torque of a motor which rotates a polishing pad is used as an index that indicates "the friction dependency on polishing speed".

Embodiment

One embodiment is described with reference to FIG. 1 to FIG. 11. According to the present embodiment, in a CMP process in a manufacturing method of a semiconductor device, the surface of a polishing pad 11 is conditioned in such a manner that its Rsk value will be negative, and that the friction dependency on polishing speed between a polish target film and the polishing pad 11 is adjusted to a value that restrains the occurrence of a stick slip, and then the polish target film is brought into contact with (slides on) the rotating polishing pad 11. As a result, scratches on the surface of the polish target film after CMP can be reduced. The manufacturing method of the semiconductor device according to the present embodiment is described below in detail.

[CMP Unit]

A CMP unit for use in the manufacturing method of the semiconductor device according to the present embodiment is described below with reference to FIG. 1 and FIG. 2.

Figure 1:
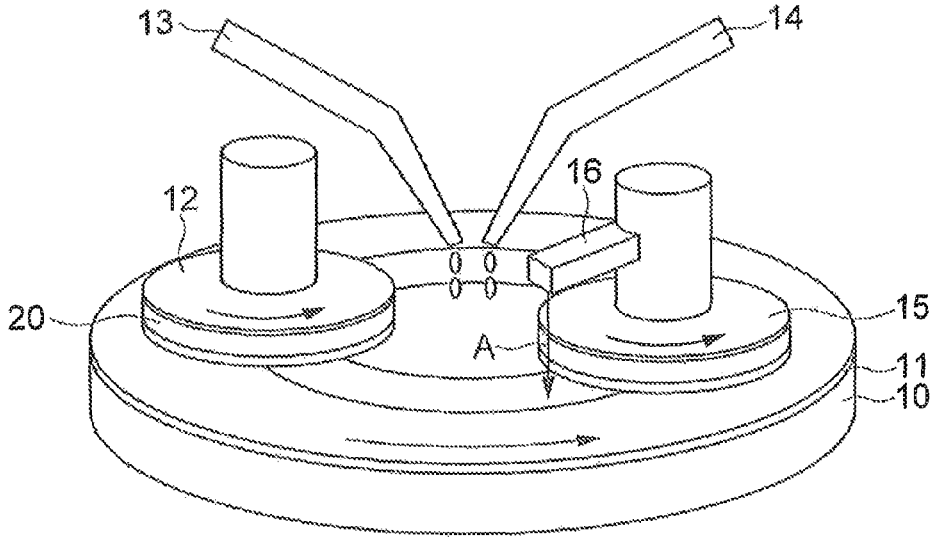
FIG. 1 is a configuration diagram showing a CMP unit according to one embodiment.

FIG. 1 is a configuration diagram showing the CMP unit for use in the present embodiment. FIG. 2 is a top view showing the CMP unit for use in the present embodiment.

As shown in FIG. 1, the CMP unit for use in the present embodiment includes a turntable 10, the polishing pad 11, a top ring 12, a slurry feed nozzle 13, dressing fluid feed nozzle 14, a dresser 15, and an inlet temperature gauge 16.

The top ring 12 holding a semiconductor substrate 20 is brought into contact with the top of the polishing pad 11 attached to the top of the turntable 10. For example, a silicon oxide film as a process target film is formed on the semiconductor substrate 20. The turntable 10 can rotate at 1 to 200 rpm, and the top ring 12 can rotate at 1 to 200 rpm. The turntable 10 and the top ring 12 rotate in the same direction, and, for example, rotate counterclockwise. During CMP, the turntable 10 and the top ring 12 rotate in a constant direction. Their polishing loads are generally 50 to 500 hPa. In the present embodiment, the semiconductor substrate 20 corresponds to, for example, a substrate. The substrate is not limited to the semiconductor substrate. For example, a glass substrate or a ceramic substrate can also be used.

The slurry feed nozzle 13 is disposed on the polishing pad 11. A predetermined chemical can be fed from the slurry feed nozzle 13 as slurry at a flow volume of 50 to 1000 cc/min. The slurry feed nozzle 13 is provided, but not exclusively, in the vicinity of the center of the turntable 10, and may be suitably provided in such a manner that the slurry will be fed to the entire surface of the polishing pad 11.

The dresser 15 is brought into contact with the polishing pad 11, and thereby conditions the surface of the polishing pad 11. The dresser 15 can rotate at 1 to 200 rpm. For example, the dresser 15 rotates counterclockwise. During conditioning, the turntable 10 and the dresser 15 rotate in a constant direction. Their dressing loads are generally about 50 to 500 hPa. The inlet temperature gauge 16 which is an infrared radiation thermometer is disposed on a column (dresser driving shaft) connected to the dresser 15. The inlet temperature gauge 16 will be described later in detail.

Furthermore, the dressing fluid feed nozzle 14 is disposed on the polishing pad 11. A predetermined chemical can be fed from the dressing fluid feed nozzle 14 as a dressing fluid at a flow volume of 50 to 1000 cc/min. The dressing fluid feed nozzle 14 is provided, but not exclusively, in the vicinity of the center of the turntable 10, and may be suitably provided in such a manner that the dressing fluid will be fed to the entire surface of the polishing pad 11.

The dressing fluid is, for example, pure water, and its feed temperature is suitably set. An inlet temperature, which is measured by the inlet temperature gauge 16, can be adjusted by controlling the feed temperature of the dressing fluid.

Figure 2:
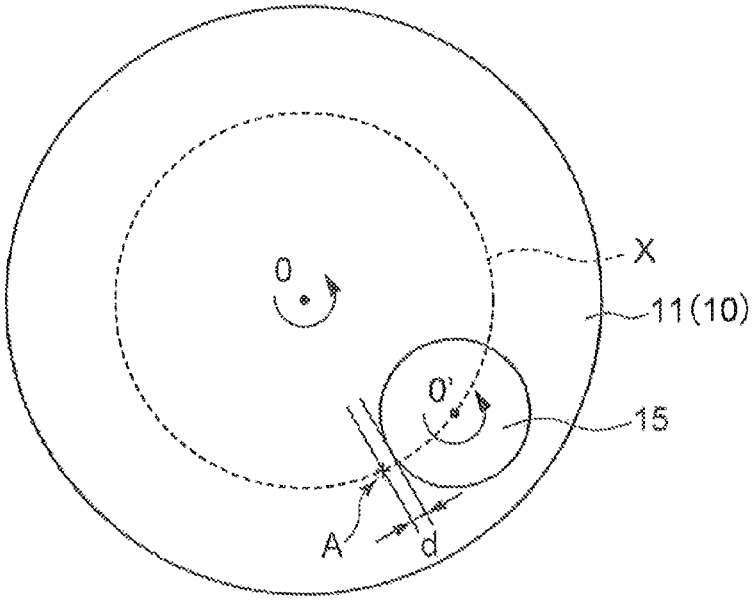
FIG. 2 is a top view showing the CMP unit according to one embodiment.

As shown in FIG. 2, the inlet temperature gauge 16 is located on the upstream side of the rotation direction of the turntable 10 relative to the dresser 15. Thus, the inlet temperature gauge 16 measures the surface temperature (inlet temperature) of the polishing pad 11 on the upstream side of the rotation direction of the turntable 10 relative to the dresser 15.

The inlet temperature gauge 16 also measures the temperature of the polishing pad 11 on a circular path X passing through a center O' of the dresser 15 and having a given distance around a center O of the turntable 10. This arrangement is intended to enable to measure the maximum temperature, as the dresser 15 and the polishing pad 11 are in contact with each other for a long time on the circular path X.

In the vicinity of the edge of the dresser 15, the dressing fluid collides with the dresser 15 and rises. Thus, when the temperature is measured in the vicinity of the edge of the dresser 15, the inlet temperature gauge 16 may wrongly measure the temperature of the dressing fluid instead of the surface temperature of the polishing pad 11. In order to measure the surface temperature of the polishing pad 11, the inlet temperature gauge 16 preferably measures the temperature at an inlet temperature measuring point A which is located on the circular path X and which is away from the dressing fluid by a distant d (e.g. 10 mm).

When the dressing fluid is fed to the entire surface of the polishing pad 11, the temperature is not exclusively measured at the inlet temperature measuring point A as the surface temperature of the polishing pad 11, and may be measured anywhere on the surface of the polishing pad 11. That is, the inlet temperature gauge 16 may be located anywhere as long as the inlet temperature gauge 16 can measure anywhere on the surface of the polishing pad 11.

[Manufacturing Method]

The manufacturing method of the semiconductor device according to the present embodiment is described below with reference to FIG. 3.

Figure 3:
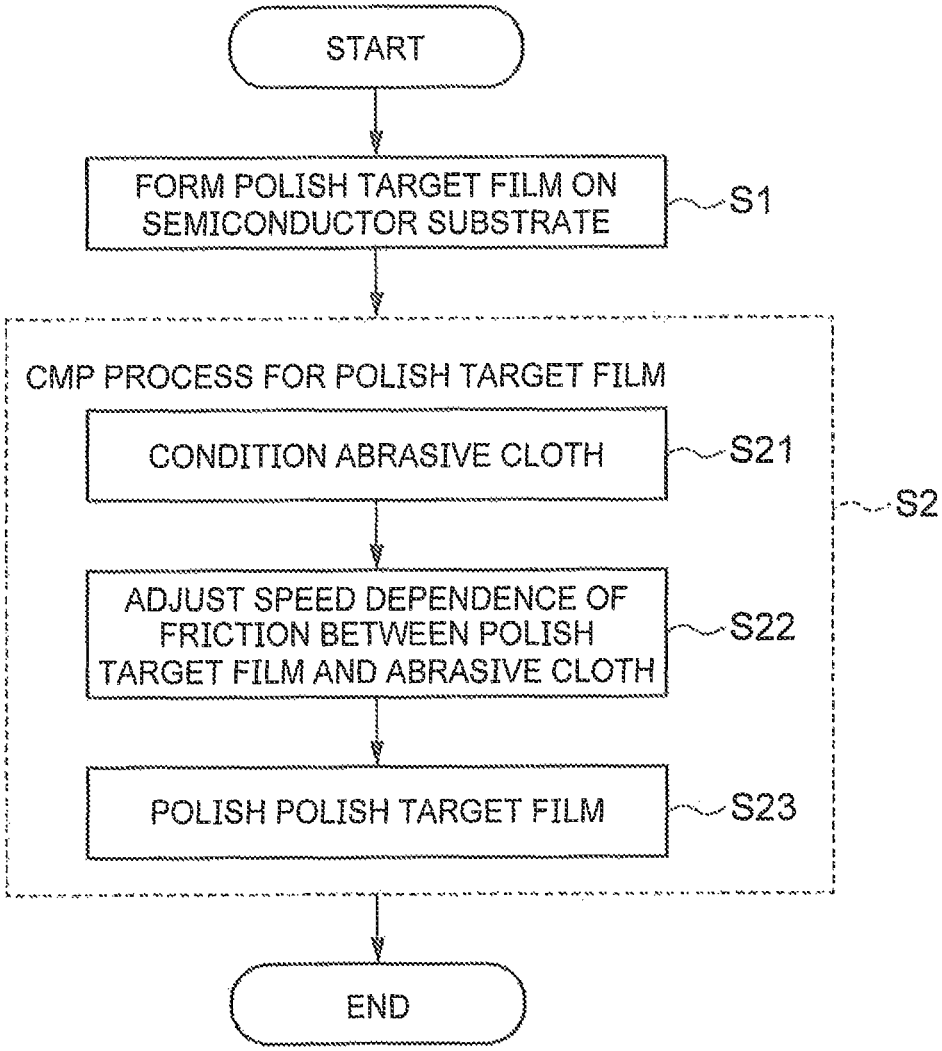
FIG. 3 is a flowchart showing a manufacturing method of a semiconductor device according to one embodiment.

FIG. 3 is a flowchart showing the manufacturing method of the semiconductor device according to the present embodiment.

As shown in FIG. 3, first, in step S1, a polish target film is formed on the semiconductor substrate 20. This polish target film is, but is not limited to, for example, a silicon oxide film for the formation of an STI structure or a PMD structure.

In step S2, a CMP process is conducted for the polish target film. Here, the CMP process according to the present embodiment is conducted under the following conditions, First, in step S21, the polishing pad 11 is conditioned. More specifically, the dresser 15 is brought into contact with the polishing pad 11, and the dresser 15 and the polishing pad 11 slide on each other. A dressing fluid such as pure water is fed to the surface of the polishing pad 11 by the dressing fluid feed nozzle 14.

Here, for example, the polishing pad 11 which is mainly made of polyurethane and which has a Shore D hardness of 50 or more and 80 or less and which has an elastic modulus of 200 MPa or more and 700 MPa or less is attached to the turntable 10. For example, the rotational speed of the turntable 10 is 10 rpm or more and 110 rpm or less. For example, the dresser 15 having a diamond roughness of #100 or more and #200 or less (manufactured by Asahi Diamond Corporation) is used. For example, the rotational speed of the dresser 15 is 10 rpm or more and 110 rpm or less, and the dressing load is 50 hPa or more and 300 hPa or less. For example, the time of the conditioning is 60 seconds.

In this case, when the pure water is fed, the feed temperature and feed flow volume of the pure water are controlled in such a manner that the surface temperature of the polishing pad 11 (the temperature at the inlet temperature measuring point A by the inlet temperature gauge 16) will be 23° C. or more. As a result, the Rsk value of the polishing pad 11 can be −0.5 or less.

In step S22, the friction dependency on polishing speed between the polish target film and the polishing pad 11 is then adjusted. The friction dependency on polishing speed is adjusted to a value that restrains the occurrence of a stick slip.

In step S23, the polish target film is polished. More specifically, the polish target film held by the top ring 12 is brought into contact with the conditioned polishing pad 11, and the polish target film and the polishing pad 11 slide on each other. Here, for example, the rotational speed of the top ring 12 is 120 rpm, and the polishing load is 300 gf/cm$^2$. Slurry is fed from the slurry feed nozzle 13 at a flow volume of 100 cc/min. The slurry contains, for example, cerium oxide (DLS2 manufactured by Hitachi Chemical Corporation) and polycarboxylic acid ammonium (TK75 manufactured by Kao Corporation) as abrasive grains.

In this way, the friction dependency on polishing speed between the polish target film and the polishing pad 11 is adjusted to the value that restrains the occurrence of the stick slip. The surface of the polish target film is then brought into contact with the surface of the rotating polishing pad 11 with an Rsk value of −0.5 or less and polished. In consequence, the number of scratches on the surface of the polish target film after polishing can be reduced. The reasons will be described later.

The friction dependency on polishing speed has only to be a value beyond −0.2 Nm/rpm. The Rsk value in the surface of the polishing pad 11 is preferably −0.5 or less, and is particularly preferably −0.1 or less. However, the Rsk value in the surface of the polishing pad 11 is not limited thereto, and has only to be at least negative. As will be described later, the Rsk value of the polishing pad 11 decreases (becomes a negative value with a high absolute value) if the surface temperature of the polishing pad 11 is increased, for example, in the conditioning. In other words, it is preferable to raise the surface temperature of the polishing pad 11 to decrease the Rsk value in the conditioning. Nevertheless, the surface temperature of the polishing pad 11 may be 23° C. or less as long as the Rsk value of the polishing pad 11 can be negative. However, the conditioning is not at all limited to heating conditioning. It is also possible to decrease the Rsk value by changing the shape (e.g. structure or material) of a conditioner or changing the material and structure (e.g. pore size and density) of the polishing pad.

Figure 4:
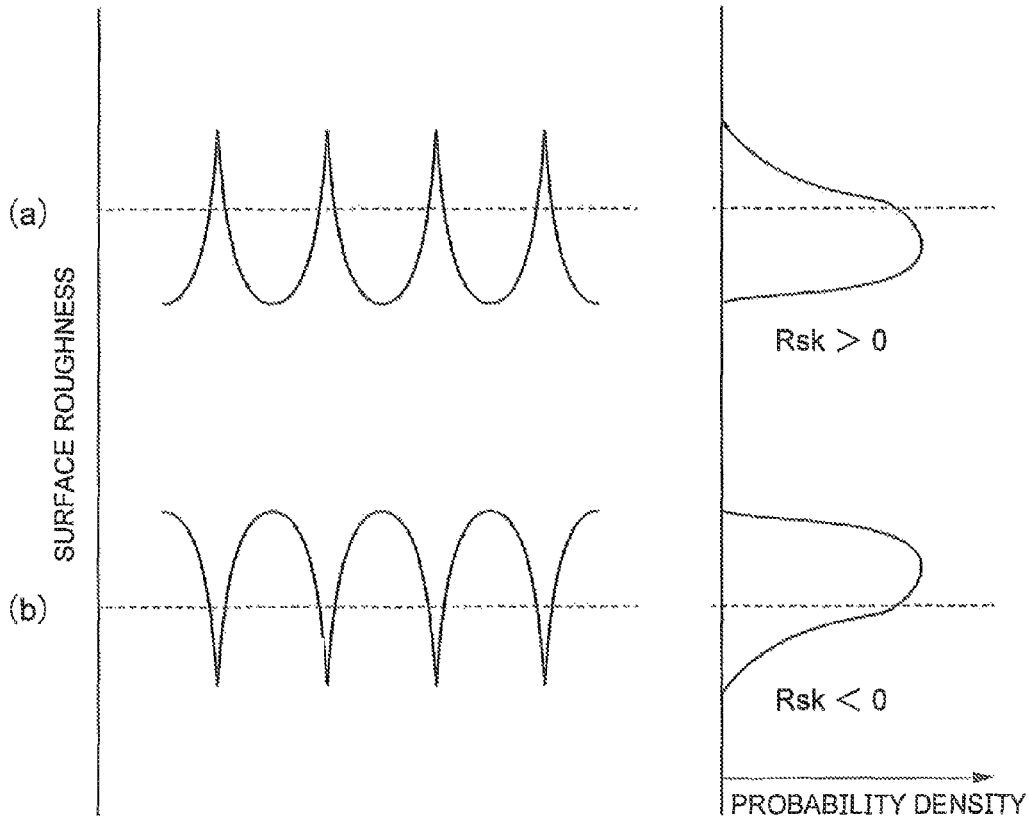
FIG. 4 is a graph illustrating an Rsk value.

FIG. 4 is a graph illustrating the Rsk value.

The Rsk value (roughness curve skewness value) represents the relativity of a probability density distribution to an average line of a surface roughness profile.

The Rsk value is said to be positive when the probability density distribution is eccentrically-located on the side below the average line of the surface roughness profile as shown in the upper part (a) of FIG. 4. In this case, there are a large number of protruding parts, and a flat part is smaller.

On the other hand, the Rsk value is said to be negative when the probability density distribution is eccentrically-located on the side above the average line of the surface roughness profile as shown in the lower part (b) of FIG. 4. In this case, there are a small number of protruding parts, and the flat part is larger.

Consequently, the negative Rsk value means that the surface is smoother than when the Rsk value is positive.

[Grounds for CMP Conditions]

The grounds for CMP conditions according to the present embodiment are described below with reference to FIG. 5 and FIG. 6.

First, a polishing experiment was conducted to examine the relation between the Rsk value of the surface of the polishing pad 11 and the number of scratches on the surface of the polish target film.

Figure 5:
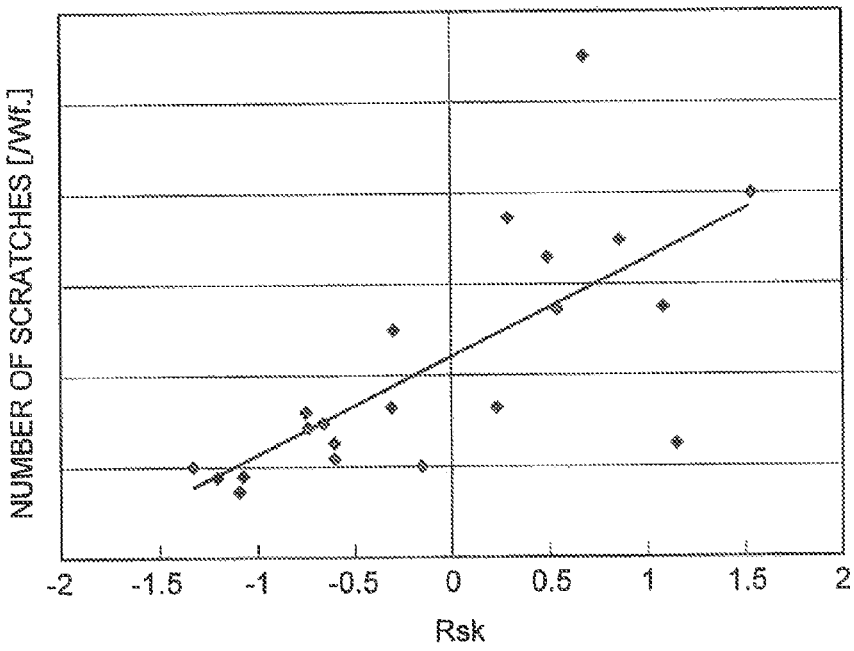
FIG. 5 is a graph showing the relation between the Rsk value of the surface of a polishing pad and the number of scratches on the surface of a polish target film according to a polishing experiment.

FIG. 5 is a graph showing the relation between the Rsk value of the surface of the polishing pad 11 and the number of scratches on the surface of the polish target film according to the polishing experiment, Here, the Rsk value was calculated from roughness measured by an enhanced viewing field laser microscope such as HD100D (manufactured by Lasertec Corporation). The surface of the polish target film was lightly etched with a diluted hydrofluoric acid after CMP, and then the number of scratches was counted by KLA2815 (manufactured by KLA-Tencor Corporation, SEM review).

As shown in FIG. 5, when the surface of the polish target film is brought into contact with the surface of the polishing pad 11 and then polished, there is a positive correlation (correlation coefficient of 0.71) between the Rsk value of the surface of the polishing pad 11 during polishing, and the number of resulting scratches on the surface of the polish target film. In other words, the number of scratches on the surface of the polish target film is larger when the Rsk value of the surface of the polishing pad 11 is higher, and the number of scratches is smaller when the Rsk value is lower.

When the Rsk value of the surface of the polishing pad 11 is negatively higher (becomes a negative value with a high absolute value), the number of scratches on the surface of the polish target film is smaller, and its variation is smaller. In particular, if the Rsk value of the surface of the polishing pad 11 is −0.5 or less, preferably −1.0 or less, the number of scratches on the surface of the polish target film is further reduced, and its variation is reduced accordingly.

As described above, the Rsk value of the surface of the polishing pad 11 is adjusted to a negative state with a higher absolute value to polish the polish target film, so that the number of scratches on the surface of the polish target film can be reduced. Thus, it is preferable that the Rsk value of the surface of the polishing pad 11 is brought to a negative value with a higher absolute value by conditioning.

Then conditioning experiments were conducted to examine the relation between the surface temperature of the polishing pad 11 and the Rsk value of the polishing pad 11. Here, the dressing fluid fed from the dressing fluid feed nozzle 14 in the above-mentioned CMP unit was controlled to adjust the surface temperature of the polishing pad 11 measured by the inlet temperature gauge 16. The conditioning experiments were conducted under the following conditions.

Polishing pad: polyurethane (having a Shore D hardness of 60 and an elastic modulus of 400 Mpa)

Turntable rotational speed: 20 rpm

Dresser: diamond roughness of #100 (manufactured by Asahi Diamond Corporation)

Dresser load: 200 hPa

Dresser rotational speed: 20 rpm

Here, the dressing fluid was pure water, and its feed temperatures were 5° C., 23° C. (room temperature), and 65° C., so that 60-second conditioning experiments were conducted, respectively. In the respective conditioning experiments, the surface temperatures of the polishing pad 11 measured by the inlet temperature gauge 16 were 9° C., 23° C., and 41° C.

Figure 6:
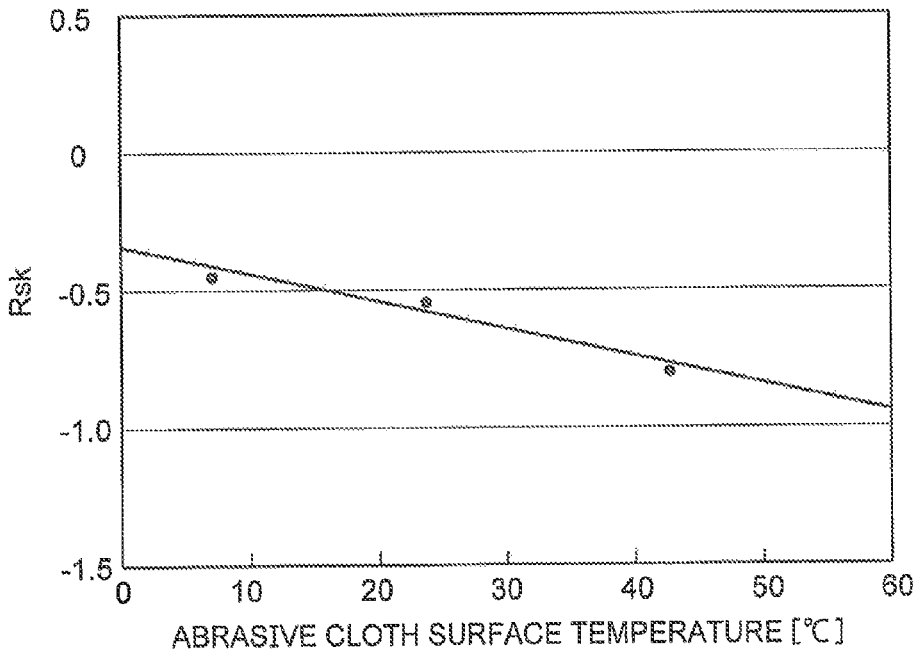
FIG. 6 is a graph showing the relation between the surface temperature of the polishing pad and the Rsk value of the polishing pad according to conditioning experiments.

FIG. 6 is a graph showing the relation between the surface temperature of the polishing pad 11 and the Rsk value of the polishing pad 11 according to the conditioning experiments.

As shown in FIG. 6, when the surface of the polishing pad 11 is conditioned by the dresser 15, there is a negative correlation between the surface temperature of the polishing pad 11 during conditioning and the resulting Rsk value of the polishing pad 11. In other words, the Rsk value of the polishing pad 11 is lower when the surface temperature of the polishing pad 11 is higher, and the Rsk value is higher when the surface temperature is lower. More specifically, when the surface temperatures of the polishing pad 11 are 9° C., 23° C., and 41° C., the Rsk values of the polishing pad 11 are −0.43, −0.56, and −0.78.

As described above, it is preferable that the Rsk value of the surface of the polishing pad 11 is adjusted to a negative value with a higher absolute value by conditioning. When the surface temperature of the polishing pad 11 in the conditioning is higher, the Rsk value of the surface of the polishing pad 11 can be a negative value with a higher absolute value. For example, when pure water is fed by the conditioning, the Rsk value of the surface of the polishing pad 11 can be sufficiently adjusted to −0.5 or less if the surface temperature of the polishing pad 11 is 23° C. or more.

On the other hand, the grinding speed of the polishing pad 11 in the conditioning depends on the surface temperature of the polishing pad 11. The grinding speed is lower when the surface temperature of the polishing pad 11 is higher, and the grinding speed is higher when the surface temperature is lower. More specifically, when the surface temperatures of the polishing pad 11 are 9° C., 23° C., and 41° C., the grinding speeds of the polishing pad 11 in the conditioning are 0.9 μm/min, 0.5 μm/min, and 0.05 μm/min, respectively. This is attributed to the fact that the polishing pad 11 is softer (lower in elastic modulus) and grinding is more difficult when the surface temperature of the polishing pad 11 is higher. Consequently, the service life of the polishing pad 11 can be prolonged by the increase of the surface temperature of the polishing pad 11.

The surface temperature of the polishing pad 11 is raised to condition the polishing pad 11 as described above, so that the Rsk value of the polishing pad 11 can be a negative value with a higher absolute value, and the grinding speed of the polishing pad 11 can be reduced.

In addition, the surface temperature of the polishing pad 11 is the inlet temperature of the polishing pad 11 measured by the inlet temperature gauge 16, the temperature may be measured anywhere on the surface of the polishing pad 11 if the dressing fluid is fed to the entire surface of the polishing pad 11.

According to the embodiment described above, in the CMP process in the manufacturing method of the semiconductor device, the surface of the polishing pad 11 is first conditioned at a higher temperature, and the surface of the polish target film is brought into contact with the surface of the polishing pad 11 to polish the polish target film. Consequently, the following advantageous effects can be obtained.

When the surface of the polishing pad 11 is conditioned at a higher temperature, the Rsk value of the polishing pad 11 can be a negative value with a higher absolute value. For example, when pure water is fed in the conditioning, the Rsk value of the surface of the polishing pad 11 can be −0.5 or less if the surface temperature of the polishing pad 11 is 23° C. or more. The surface of the polish target film is brought into contact with the surface of the polishing pad 11 with the negative Rsk value to polish the polish target film, so that the number of scratches on the surface of the polish target film after the CMP can be reduced. As a result, deterioration in device yield and reliability can be restrained.

When the surface of the polishing pad 11 is conditioned at a higher temperature, the grinding speed of the polishing pad 11 can be reduced. Consequently, the service life of the polishing pad 11 can be prolonged, and costs in the CMP process can be reduced.

Meanwhile, even if the Rsk value of the surface of the polishing pad 11 is set to a negative value with a high absolute value, there are some cases in which the number of scratches is increased by the friction dependency on polishing speed between the polishing pad 11 and the polish target surface.

Figure 7:
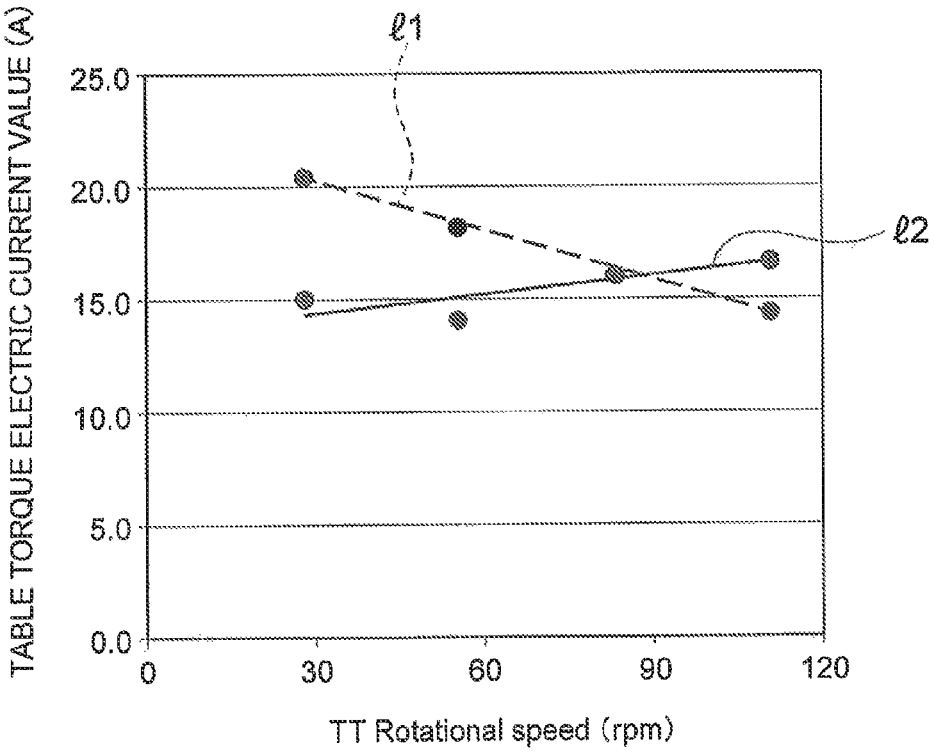
FIG. 7 is a graph illustrating the friction dependency on polishing speed.

FIG. 7 is a graph illustrating the friction dependency on polishing speed. In a broken line l1 in FIG. 7, the friction dependency on polishing speed is in a negative state of about −0.082 A/rpm. If the CMP process is conducted in this state, self-excited vibration (a stick slip phenomenon) occurs, and abnormal noise and vibration occur during CMP. In this case, a large number of caterpillar-shaped scratches which are periodic damages shown in FIG. 8 tend to occur.

Figure 8:
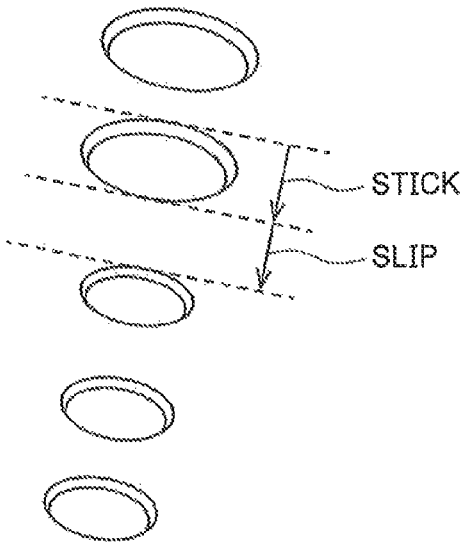
FIG. 8 is a diagram showing an example of scratches caused by a stick slip.

On the other hand, in a solid line l2 in FIG. 7, the speed dependence of friction is in a positive state of about 0.028 A/rpm. If the CMP process is conducted in this state, the occurrence of the self-excited vibration (stick slip phenomenon) is suppressed, and no abnormal noise and vibration occur during CMP. Consequently, the occurrence of the caterpillar-shaped scratches shown in FIG. 8 is controlled to about one fifth or less.

Figure 9:
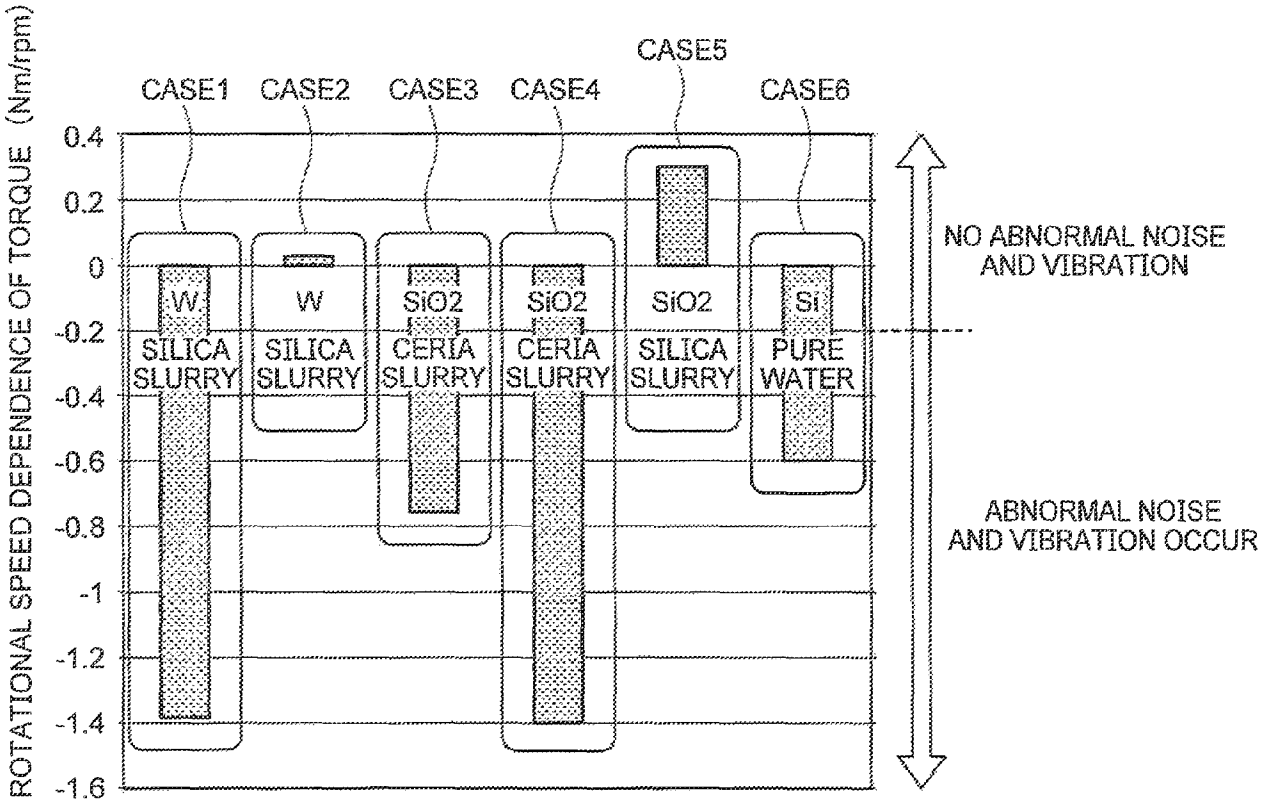
FIG. 9 is a graph illustrating the relation between a stick slip and the friction dependency on polishing speed.

FIG. 9 is a graph illustrating the relation between the friction dependency on polishing speed and the occurrence of abnormal noise and vibration according to the kind of slurry. In Cases 1 and 2, a tungsten (W) polish target surface was polished by the use of silica slurry. In Cases 3 and 4, a silicon oxide ($SiO_2$) polish target surface was polished by the use of ceria slurry. In Case 5, a silicon oxide ($SiO_2$) polish target surface was polished by the use of silica slurry. In Case 6, a silicon (Si) polish target surface was polished with pure water without the use of slurry, Experiments were conducted under the following conditions.

Top ring load: 300 hPa

Turntable rotational speed: 30 to 110 rpm

Slurry flow volume: 200 cc/min

In each of Cases 1 to 6, no abnormal noise and vibration occurred in a range in which the friction dependency on polishing speed was beyond −0.2 Nm/rpm. This is not limited to the example in FIG. 9, and has been ascertained as a result of experiments repeated at rotational speeds set within a predetermined range using various combinations of existing slurries and polish target films.

Thus, according to the present embodiment, polishing is performed in a condition in which the Rsk is negative and in which the friction dependency on polishing speed is beyond −0.2 Nm/rpm, Consequently, it is possible to lessen the concentration of stress from the surface of the polishing pad, to restrain the occurrence of the self-excited vibration caused by friction, and to considerably restrain scratches. As a result of the restraint of the occurrence of the self-excited vibration, abnormal noise and vibration during polishing are suppressed, and process stability is improved.

Applicable Example

An applicable example of the manufacturing method of the semiconductor device according to the present embodiment is described below with reference to FIG. 10 and FIG. 11. Here, a method of manufacturing an STI structure in a semiconductor device is described.

Figure 10:
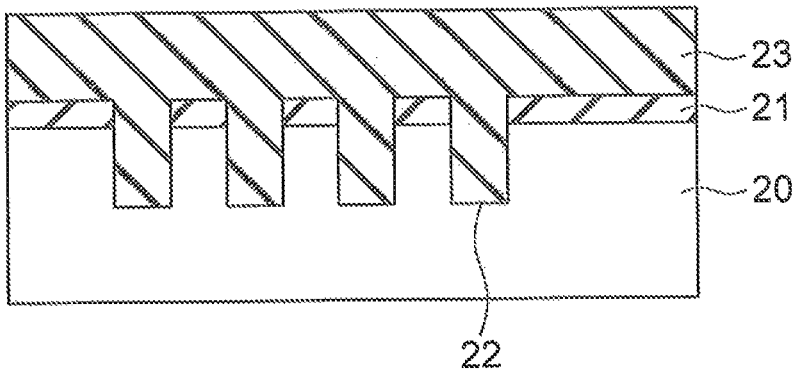
FIG. 10 is a sectional view showing an STI manufacturing process in a semiconductor device according to the present embodiment.
Figure 11:
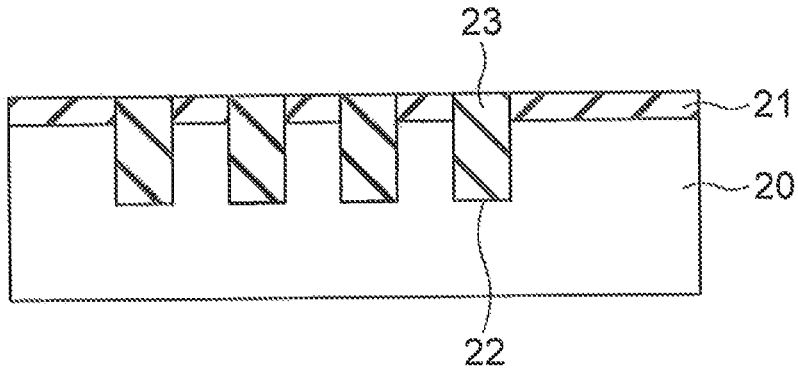
FIG. 11 is a sectional view showing the STI manufacturing process in the semiconductor device according to the present embodiment following FIG. 10.

FIG. 10 and FIG. 11 are sectional views showing an STI manufacturing process in the manufacturing method of the semiconductor device according to the present embodiment.

First, as shown in FIG. 10, a silicon nitride film 21 to be a stopper film is formed on the semiconductor substrate 20. An STI pattern 22 is then formed on the semiconductor substrate 20 using a silicon oxide film and so on as an etching mask. For example, a silicon oxide film may be provided between the semiconductor substrate 20 and the silicon nitride film 21.

A silicon oxide film 23 is then formed on the entire surface by, for example; a high-density plasma chemical vapor deposition (CVD) method, At the same time, the silicon oxide film 23 is also formed outside the STI pattern 22.

As shown in FIG. 11, CMP is conducted for the silicon oxide film 23 as a process target film, and its surface is polished. The present embodiment is applied to this CMP process. That is, the surface of the polishing pad 11 is conditioned so that its Rsk value will be negative, and the friction dependency on polishing speed between the polish target film and the polishing pad 11 is adjusted to a value beyond −0.2 Nm/rpm. The surface of the silicon oxide film 23 is then brought into contact with the surface of the polishing pad 11 to polish the silicon oxide film 23.

As a result, the silicon oxide film 23 outside the STI pattern 22 is removed, and the STI structure is formed.

However, the CMP process according to the present embodiment is not limited to the above silicon oxide film, and is also applicable to CMP conducted for various metallic materials and insulating materials as process target films.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A manufacturing method of a semiconductor device comprising:

forming a polish target film on a substrate; and conducting a CMP process for the polish target film, wherein conducting the CMP process comprises bringing a surface of the polish target film into contact with a surface of a polishing pad with a negative Rsk value, and adjusting friction dependency on polishing speed between the polish target film and the polishing pad to a value that restrains the occurrence of a stick slip to polish the polish target film.

2. The method of claim 1, wherein the Rsk value is −0.5 or less.

3. The method of claim 2,
wherein the Rsk value is −1.0 or less.

4. The method of claim 1,
wherein the CMP process further comprises, before polishing the polish target film, bringing a dresser into contact with the surface of the polishing pad and then conditioning the polishing pad while feeding dressing fluid to the surface of the polishing pad.

5. The method of claim 4,
wherein conditioning the polishing pad comprises controlling the surface temperature of the polishing pad at 23° C. or more.

6. The method of claim 4,
wherein the dressing fluid is pure water.

7. The method of claim 5,
wherein the surface temperature of the polishing pad is measured on the upstream side of the rotation direction of the polishing pad relative to the dresser.

8. The method of claim 1,
wherein the polish target film is a silicon oxide film,
the silicon oxide film is polished by using silica slurry or ceria slurry.

9. The method of claim 1,
wherein the polish target film is a tungsten (W) film,
the tungsten (W) film is polished by using silica slurry.

10. The method of claim 1,
wherein the polish target film is a silicon film the silicon film is polished by using pure water.

11. A manufacturing method of a semiconductor device comprising:
forming a polish target film on a substrate; and
conducting a CMP process for the polish target film,
wherein the CMP process comprises
polishing the polish target film in such a manner that the surface of the polish target film is brought into contact with a surface of a polishing pad with a negative Rsk value and that the friction dependency on polishing speed between the polish target film and the polishing pad is beyond −0.2 Nm/rpm.

12. The method of claim 11,
wherein the Rsk value is −0.5 or less.

13. The method of claim 12,
wherein the Rsk value is −1.0 or less,

14. The method of claim 11,
wherein the CMP process further comprises, before polishing the polish target film, bringing a dresser into contact with the surface of the polishing pad and then conditioning the polishing pad while feeding a dressing fluid to the surface of the polishing pad.

15. The method of claim 14,
wherein conditioning the polishing pad comprises controlling the surface temperature of the polishing pad at 23° C. or more.

16. The method of claim 14,
wherein the dressing fluid is pure water.

17. The method of claim 15,
wherein the surface temperature of the polishing pad is measured on the upstream side of the rotation direction of the polishing pad relative to the dresser.

18. The method of claim 11,
wherein the polish target film is a silicon oxide film,
the silicon oxide film is polished by using silica slurry or ceria slurry.

19. The method of claim 11,
wherein the polish target film is a tungsten (W) film,
the tungsten (W) film is polished by using silica slurry.

20. The method of claim 11,
wherein the polish target film is a silicon film,
the silicon film is polished by using pure water.

* * * * *